US005632479A

United States Patent [19]

Kubota et al.

[11] Patent Number: 5,632,479

[45] Date of Patent: May 27, 1997

[54] SORTER

[75] Inventors: Kazuyuki Kubota; Yoshikazu Sano, both of Yamanasi-ken, Japan

[73] Assignee: Nisca Corporation, Yamanashi-ken, Japan

[21] Appl. No.: 492,326

[22] Filed: Jun. 20, 1995

[30] Foreign Application Priority Data

Jun. 22, 1994 [JP] Japan ..... 6-164557

[51] Int. Cl.[6] ..... B65H 39/10

[52] U.S. Cl. ..... 271/296; 271/298; 271/300; 271/302

[58] Field of Search ..... 271/300, 302, 271/298, 296, 288, 287

[56] References Cited

U.S. PATENT DOCUMENTS 4,408,756 10/1983 Miyashita et al. ..... 271/288
4,836,529 6/1989 Kosaka et al. ..... 271/300 X

*Primary Examiner*—David H. Bollinger
*Attorney, Agent, or Firm*—Kane, Dalsimer, Sullivan, Kurucz, Levy, Eisele and Richard, LLP

[57] ABSTRACT

A sorter includes a feed belt for feeding a sheet, which is transferred from a sheet processor, vertically, a belt drive mechanism for running the feed belt in said one direction, a plurality of sorting trays, onto which at least one sheet is received, and which are stationary and arranged vertically, a distributing unit for distributing the sheet fed upon the running of the feed belt to a predetermined sorting tray, a press roller mechanism for pressing the sheet to the feed belt so that the sheet is frictionally engaged with the feed belt, thereby feeding the sheet upon the running of the feed belt, and moving mechanism for moving the press roller mechanism along the feed belt vertically.

27 Claims, 8 Drawing Sheets

SORTER

BACKGROUND OF THE INVENTION AND RELATED ART STATEMENT

The present invention relates to a sorter for sorting sheets, which are transferred from a sheet processor, to a plurality of sorting trays, more specifically, it relates to a sorter for sorting the sheets through a sorting treatment or grouping treatment to a plurality of stationary sorting trays using a movable distributing means.

Conventionally, it is well known a sorter which includes an endless belt which are wound between upper and lower pulleys and by which sheets are sequentially fed downward in a vertical direction, a plurality of stationary sorting trays which are arranged along the endless belt and on which sheets are received, and a distributing unit which are movable vertically and provided for distributing the sheet fed by the endless belt to a predetermined sorting tray.

In the conventional sorter, the distributing unit is set to be moved along the endless belt in a condition where it is always remote from the endless belt by a predetermined very small gap. On the other hand, it is necessary to contact the sheet with the outer surface of the endless belt by a predetermined frictional engagement in order to stably feed the sheet in accordance with the running of the endless belt. Accordingly, a several constructions for contacting the sheet with the endless belt are proposed.

Theoretically, it is best to provide a plurality of rollers which are arranged in the vertical direction and always rolling-contacting the outer surface of the endless belt so that the sheet is clamped between the roller and the endless belt whereby the sheet is forcibly engaged with the endless belt by the roller. However, it is impossible to provide the plurality of rollers because the distributing unit must also be moved in the vertical direction and set to be in the closed position relative to the endless belt. That is to say, the rollers and the distributing unit are interfered with each other at the vertical movement of the distributing unit.

As conventional example which is disclosed in U.S. Pat. No. 4,408,756 to Miyashita et al., as shown in FIG. 1, a sorter 100 includes a vacuum case 102 which is arranged in an inner area of the endless belt 104 in such a manner that the opened surface of the vacuum case 102 is contacted with the inner surface of the endless belt 102 on the side where the distributing unit is arranged, and an air suction fan 106 is attached to the vacuum case 102 for causing the inner pressure of the vacuum case 102 be negative, while a multiple small holes (not shown) are formed to the endless belt 104 over the total length thereof. By constructing as described above, the sheet is sucked onto the outer surface of the endless belt 104, whereby the sheet is fed in accordance with the running of the endless belt 104.

However, in the conventional sorter 100 shown in FIG. 1, the construction of the sorter is more complicated and cost thereof is relative high as well as the suction noise from the vacuum case will arise to disturb the office environment. Furthermore, it is very difficult to peel the sheet from the endless belt because the all area of the sheet is closely contacted with or attached to the outer surface of the endless belt 104.

SUMMARY OF THE INVENTION

The present invention, therefore, has as its principal object to provide a sorter which can stably feed sheets in accordance with the running of the endless belt using a roller while the sheets are distributed to a predetermined stationary sorting tray by a distributing unit which is movable in the vertical direction.

Further it is another object of the present invention to provide a sorter which is capable of causing the sheet to contact with an endless belt by a predetermined frictional engagement by using a roller without interfering the vertical movement of a distributing unit for distributing the sheets to a predetermined stationary sorting tray.

In order to attain the above-mentioned object, there is provided a sorter according to a first aspect of the present invention which comprises: a feed belt for feeding a sheet, which is transferred from a sheet processor, in one direction; belt drive means for running the feed belt in said one direction; a plurality of sorting trays, onto which at least one sheet is received, and which are stationary and arranged along said feed belt; distributing means for distributing the sheet fed upon the running of said feed belt to a predetermined sorting tray, said distributing means being movable along said feed belt to face to said predetermined sorting tray; press means for pressing the sheet to the feed belt so that the sheet is frictionally engaged with said feed belt, thereby feeding the sheet upon the running of the feed belt, said press means being movable along said feed belt; and moving means for moving said press means along said feed belt in said one direction or a direction opposite to said one direction selectively.

According to a second aspect of the present invention, there is provided a sorter which comprises: a feed belt for feeding a sheet, which is transferred from a sheet processor, in one direction; belt drive means for running the feed belt in said one direction; a plurality of sorting trays, onto which at least one sheet is received, and which are stationary and arranged along said feed belt; distributing means for distributing the sheet fed upon the running of said feed belt to a predetermined sorting tray, said distributing means being movable along said feed belt to face to said predetermined sorting tray; drive means for driving said distributing means to move along said feed belt in said one direction or in a direction opposite to said one direction selectively; press means for pressing the sheet to the feed belt so that the sheet is frictionally engaged with said feed belt, thereby feeding the sheet upon the running of the feed belt, said press means being movable along said feed belt; and moving means for moving said press means along said feed belt in said one direction or in a direction opposite to said one direction selectively.

BRIEF DESCRIPTION OF DRAWINGS

These and other objects of the subject invention will become more fully apparent as the following description is read in light of the attached drawings wherein.

DETAILED DESCRIPTION OF THE PREFERRED EMBODIMENT

Hereinafter, the detailed description of the preferred embodiment of a sorter according to the present invention will be given with reference to the accompanying drawings of FIGS. 2 through 8.

Description of the entire construction of sorter 10

Figure 1:
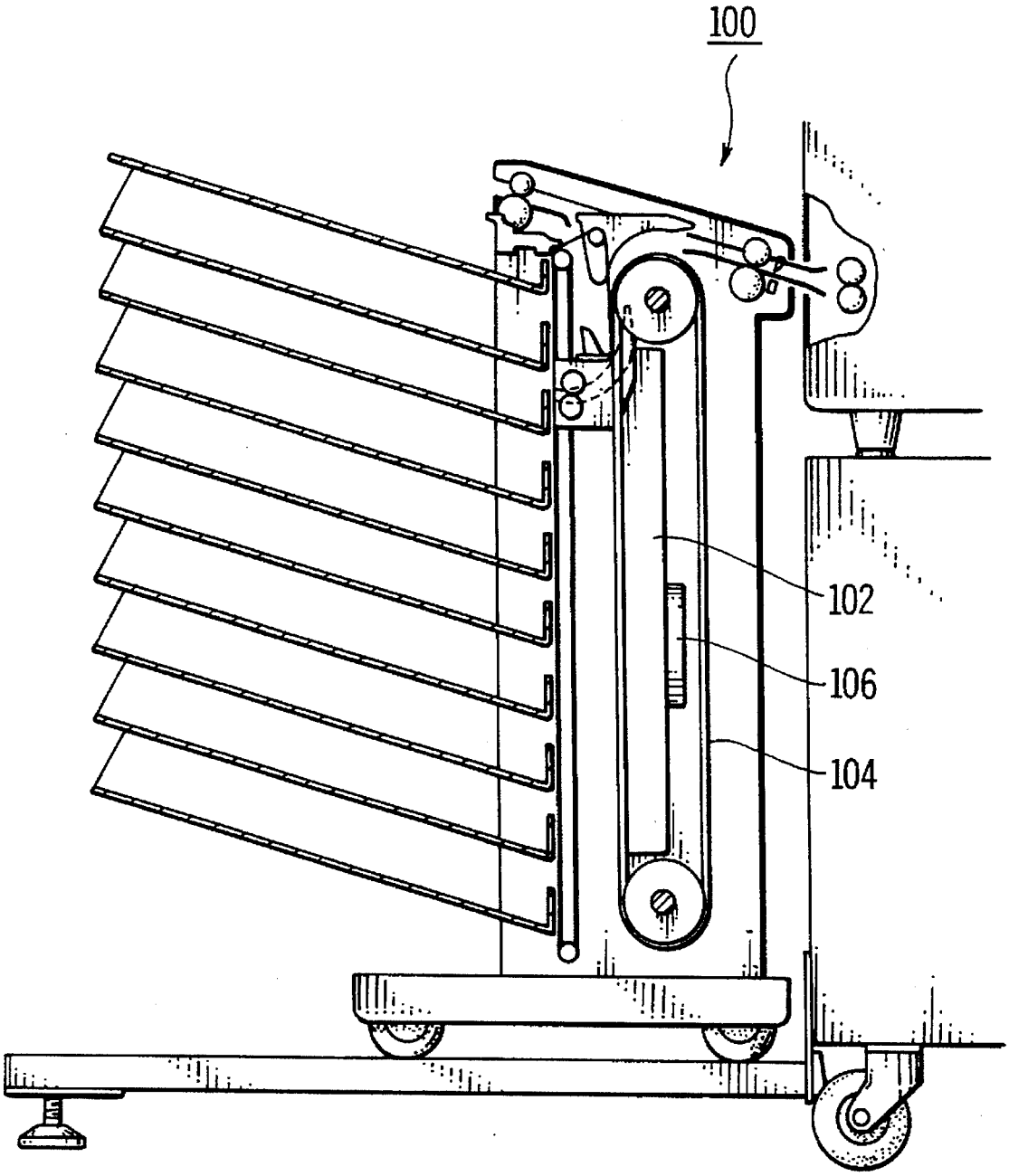
FIG. 1 PRIOR ART
FIG. 1 is a schematic front view showing a conventional structure of a sorter.
Figure 2:
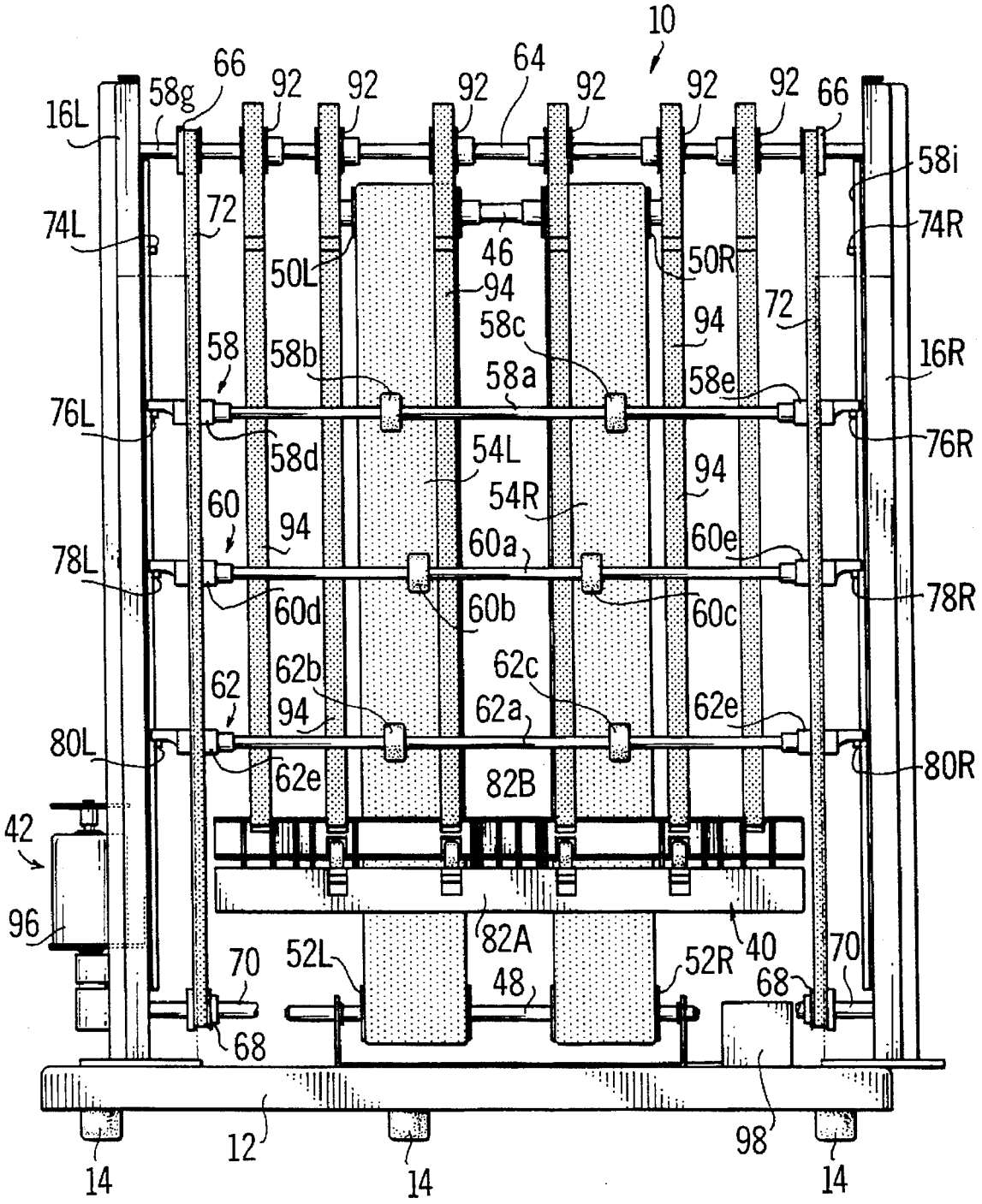
FIG. 2 is a side view showing a sorter of the preferred embodiment according to the present invention.

As shown in FIG. 2, the sorter 10 of the present embodiment is detachably attached to an electrostatic copying machine (not shown) as a sheet processor. The sorter 10 is to be connected mechanically and electrically to the copying machine and constructed so as to execute a so-called "sorting treatment" and so-called "grouping treatment" selectively, to a plurality of copied sheets transferred from the copying machine.

In the present embodiment, the sorting treatment means that, in the case where plural pages of originals are copied to sheets by a plural sets in the copying machine, each set of copied sheets on a sorting tray includes all of the pages copied. On the other hand, the grouping treatment means that, in the case where plural pages of the originals are copied to sheets by plural sets in the copying machine, each set on a sorting tray includes a plurality of copied sheets of the same page.

The copying machine includes an electrostatic copying process mechanism contained in a housing and a discharge port which is formed to the side surface of the housing and through which sheet on which an image of a document is copied is discharged. The mechanism of the copying machine is well known, therefore, the detailed description of the copying machine will be omitted.

Description of skeleton of sorter 10

The sorter 10 is provided with a base 12 which is movable on a floor through casters 14 attached to the undersurface of the base 12, and a frame 16 fixed onto the base 12. An inlet port 18 is formed to an upper portion of the side surface of the frame 16 in such a manner that the inlet port 18 opposes to the discharge port of the copying machine. Where the sorter 10 is attached to the copying machine in the predetermined position, the sorter 10 is fixed thereto through a magnet catch and the inlet port 18 is set to be communicated with the discharge port. Accordingly the copied sheets discharged from the copying machine through the discharge port are introduced inside the frame 16 of the sorter 10 through the inlet port 18.

The frame 16 includes a pair of left and right side plates 16L and 16R which are arranged on both sides of the frame 16, respectively. The side plates 16L and 16R are opposed to each other and apart from each Other by a distance corresponding to a width of a sorting tray 20 which will be described below in detail.

The sorter 10 is further provided with a plurality of stationary sorting trays 20, more specifically, fourteen sorting trays 20A through 20N in the present embodiment. The proximal end of each sorting tray 20 is arranged to be clamped between the left and right side plates 16L and 16R of the frame 16 and distal end thereof is protruded from the frame 16 to outside (to left in FIG. 2). Each of the sorting trays 20 is set to be detachably attached to the frame 16 as described later.

Description of sorting tray 20

Figure 3:
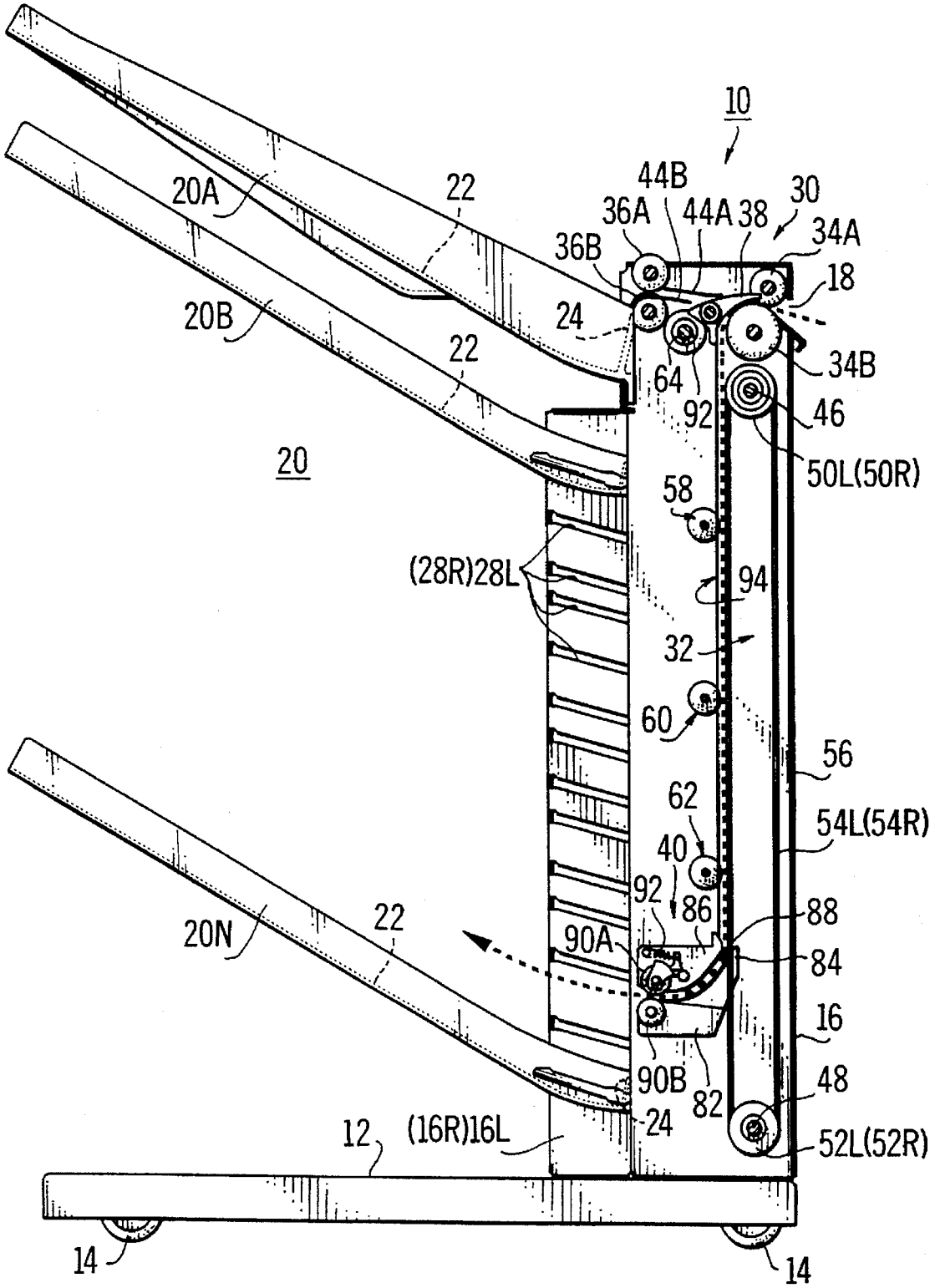
FIG. 3 is a front view showing the sorter shown of the present embodiment.
Figure 4:
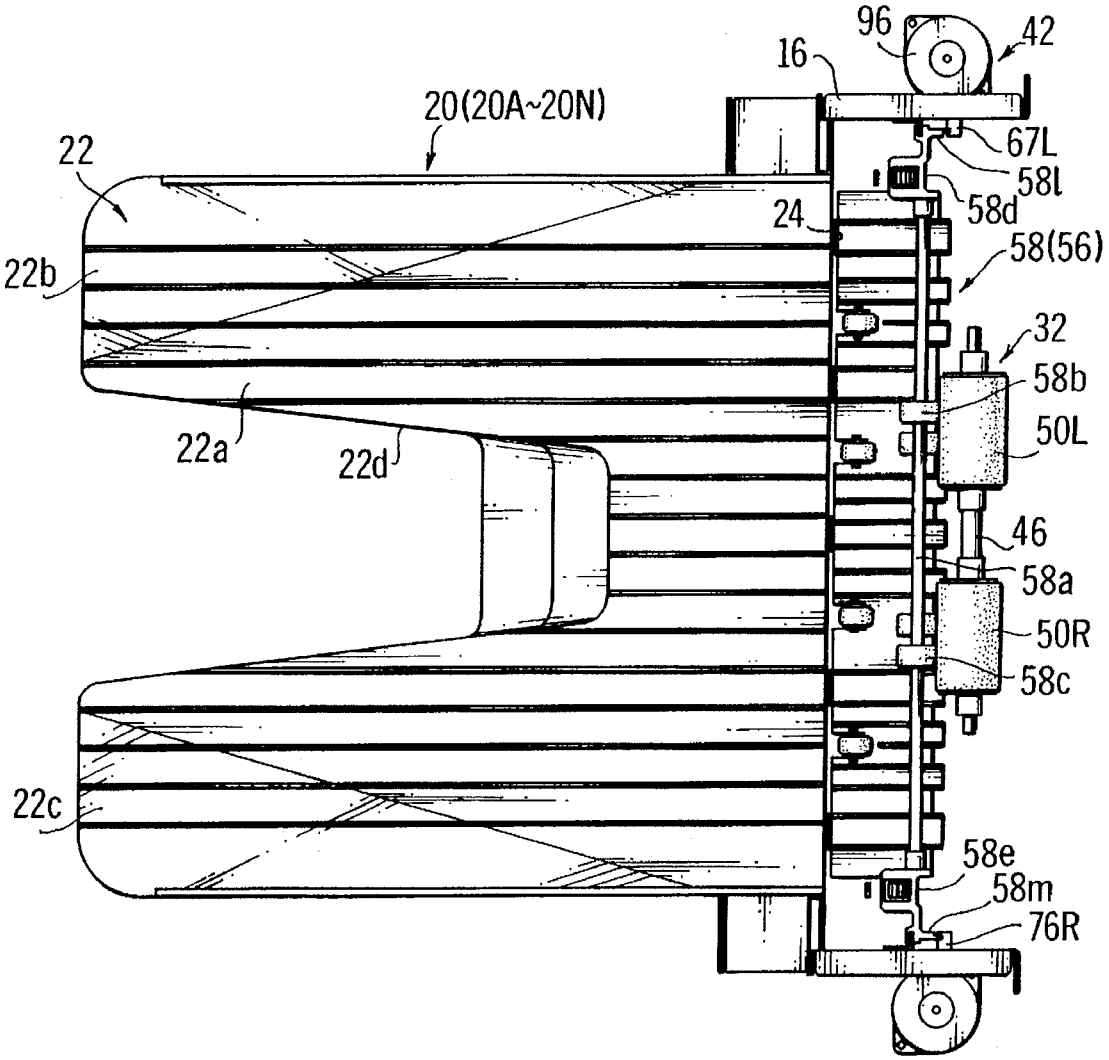
FIG. 4 is a plan view showing a sorting tray provided in the sorter.

As shown in FIGS. 3 and 4, each of the sorting trays 20 extends in a sheet take-in direction X in which the copied sheets are taken in the frame 16 through the inlet port 18. All of the sorting trays 20 (20A to 20N) are set to be parallel to each other, as shown in FIG. 3.

As shown in FIG. 4, each sorting tray 20 is provided with a receiving plate 22 which is inclined to the horizontal plane by a predetermined angle so that the distal end of the sorting tray 20 is higher than the proximal end thereof and on which the copied sheets are received, and a stop plate 24 which stands at a proximal end of the receiving plate 22 and against which the copied sheet received on the receiving plate 22 is slid to abut.

That is, the copied sheet which is transferred from the copying machine is received on the receiving plate 22 at a substantially mid point thereof, and then it is slid in a direction opposite to the sheet take-in direction X due to the inclination of the receiving plate 22. As a result, a proximal end of the sheet on the upstream side with respect to the sheet take-in direction X is come to abut against the stop plate 24, accordingly all of the copied sheets stacked on the sorting tray 20 are aligned to each other at the proximal end thereof.

The receiving plate 22 of the sorting tray 20 includes a flat main portion 22*a*, and a pair of slant portions 22*b* and 22*c* which are slant upward to the main portion 22*a* and positioned on the downstream side with respect to the sheet take-in direction X and both lateral sides of the main portion 22*a*. A recessed portion 22*d* is formed to the center of the distal end of the main portion 22*a*, for facilitating the grip of the copied sheets received on the sorting tray 20 by an operator.

As shown in FIG. 2, the uppermost sorting tray 20A is defined as a non-sorting tray on which all sheets are stacked when a non-sort mode is selected. The next through last or lowermost sorting trays 20B through 20N are defined as the first through thirteenth sorting trays on which sheets are stacked by the sorting treatment or the grouping treatment when a sort mode is selected.

A pair of left and right engaging pieces 26L and 26R are integrally formed to the both sides of each receiving plate 22 and extend in the same plane thereof, respectively. On the other hand, fourteen engaging grooves 28L are formed to the inside surface of the left side plate 16L with the same interval and fourteen engaging groove 28R are formed to the inside surface of the right side plates 16R with the same interval. Each of the engaging grooves 28L and 28R is inclined to the horizontal plane by the predetermined angle.

The fourteen engaging grooves 28L on the left side are flush with the corresponding engaging grooves 28R on the right side, respectively. In other words, the left and right engaging grooves 28L and 28R with the same level or height constitute one pair of engaging grooves.

The engaging pieces 26L and 26R of each sorting tray 20 are formed to be capable of inserting into the paired engaging grooves 28L and 28R, respectively. That is to say, each of the sorting trays 20 is attached to the frame 16 by inserting the engaging pieces 26L and 26R into the paired engaging grooves 28L and 28R, respectively.

Description of sheet take-in mechanism 30

As shown in FIG. 3, a sheet take-in mechanism 30 is provided for taking the copied sheet from the inlet port 18 into the frame 16, and selectively feeding it to the non-sorting tray 20A or a sheet feed mechanism 32 which will be described later in detail. The sheet feed mechanism 30 is provided between the inlet port 18 and the non-sorting tray 20A and provided with a pair of upper and lower inlet rollers 34A and 34B on the side of inlet port 18 and a pair of upper and lower outlet rollers 36A and 36B on the side of the non-sorting ray 20A.

The upper inlet roller 34A is pressingly contacting the lower inlet roller 34B and the nip between the upper and lower inlet rollers 34A and 34B is aligned with the inlet port 18. The upper outlet roller 36A is pressingly contacting the lower outlet roller 36B and the nip between the upper and lower outlet rollers 36A and 36B is located just above the top of the stop plate 24 of the non-sorting tray 20A.

The sheet take-in mechanism 30 further includes a flapper 38 disposed between the inlet rollers 34A and 34B and the outlet rollers 36A and 36B, for switching the feed path of the sheet, which is taken in by the inlet rollers 34A and 34B, to the outlet rollers 36A or the sheet feed mechanism 32. The flapper 38 is rotatably supported about a horizontal axis which is perpendicular to the sheet take-in direction X between a non-sort rotational position where the sheet transferred from the inlet rollers 34A and 34B is passed through straightly to be directly fed to the outlet rollers 36A and 36B and a sort rotational position where a path of the sheet transferred from the inlet rollers 34A and 34B is changed downward so that the sheet is fallen down to the sheet feed mechanism 32.

In the natural condition of the flapper 38, in other words, when no force is applied to the flapper 38, the flapper 38 is held in the sort rotational position by its own weight, while it will be rotated from the sort rotational position to the non-sort rotational position whereby a distributing unit 40, which will be described later in detail, is driven to raise up to an uppermost non-sorting position by a unit drive mechanism 42, which will be described later in detail, and abut against the flapper 38. If the distributing unit 40 is driven to descend from the non-sorting position, the flapper 38 is automatically returned from the non-sort rotational position to the sort rotational position by its own weight.

The sheet take-in mechanism 30 still further includes an upper and lower guide plates 44A and 44B which are disposed between the outlet rollers 36A and 36B and the flapper 38, for guiding the sheet, which is selected to be fed to the non-sorting tray 20A by the flapper 38 in the non-sort rotational position, to the nip of the outlet rollers 36A and 36B.

Description of sheet feed mechanism 32

As shown in FIGS. 2 and 3, the sheet feed mechanism 32 is provided for feeding the sheet, the feed path of which is changed to downward by the flapper 38 in the sort rotational position, downward. The sheet feed mechanism 32 includes an upper horizontal driven pulley shaft 46 and a lower horizontal driving pulley shaft 48 each of which extends in a direction perpendicular to the sheet take-in direction X and is supported to left and right support pillars, which are not shown but planted on the base 12, at both ends thereof so as to be rotatable about its central axis.

Left and right driven pulleys 50L and 50R are coaxially fixed to the upper pulley shaft 46, and left and right driving pulleys 52L and 52R are coaxially fixed to the lower pulley shaft 48. A left endless belt 54L is wound around the left side pulleys 50L and 50R and a right endless belt 54R is wound around the right side pulleys 50R, as a feed belt.

A feed motor (not shown) is connected to the lower driving pulley shaft 48 to rotate. The feed motor is set to rotate the lower driving pulley shaft 48 counterclockwise in FIG. 3, thereby running the left side portions of the endless belts 54L and 54R downward in FIG. 3.

Description of press roller mechanism 56

As shown in FIG. 3, the sheet feed mechanism 32 further includes a press roller mechanism 56 for pressing the sheet against the endless belts 54L and 54R to frictionally engage the sheet with the endless belts 54L and 54 R so that the sheet is forced to be fed downward in accordance with the running of the endless belts 54L and 54R. The press roller mechanism 56 is provided with plural sets, for example three sets in the present embodiment, of press roller assemblies 58, 60 and 62 which are arranged vertically and movable in a vertical direction.

Since the three sets of press roller assemblies 58, 60 and 62 are set to be substantially identical with a little difference with respect to their dimensions, the description about the uppermost first press roller assembly 58 will only be given as follows and the detailed description about the second and third press roller assemblies 60 and 62 will be omitted.

Figure 5:
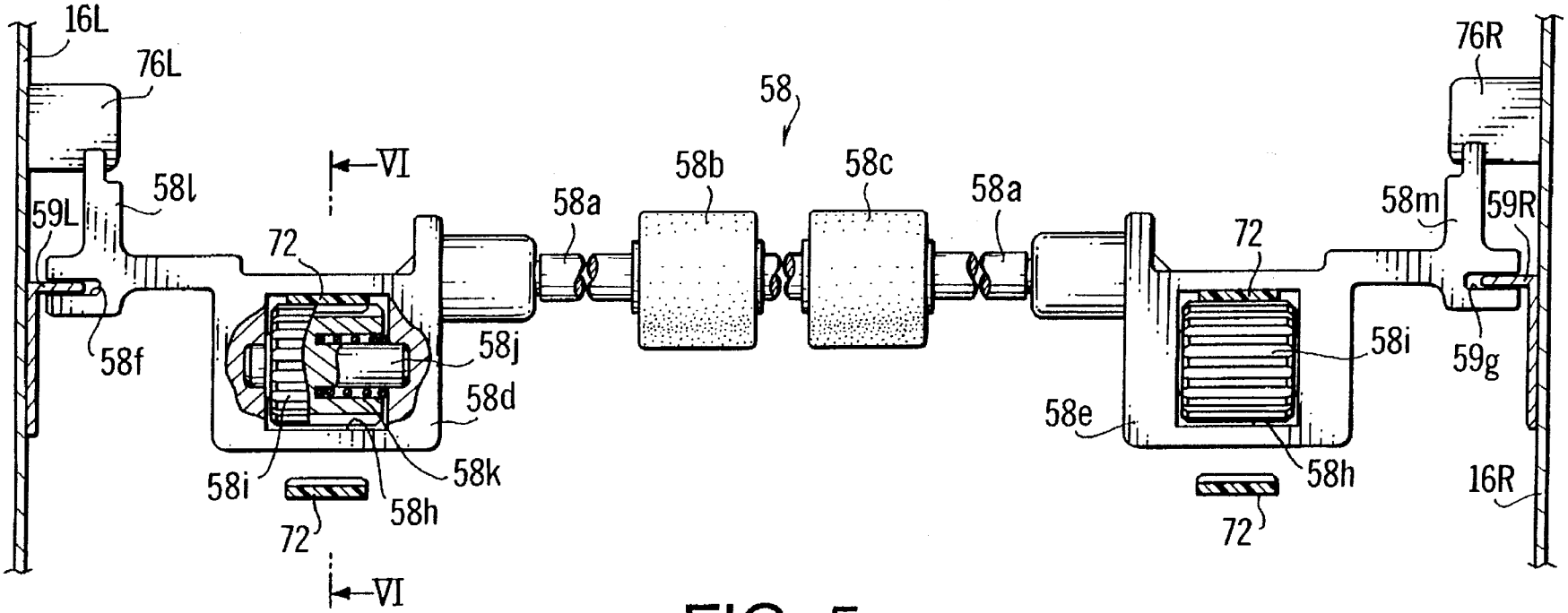
FIG. 5 is a plan view showing a first press roller assembly of a press roller mechanism arranged in the sorter of the preferred embodiment.

As shown in FIG. 5, the first press roller assembly 58 includes a horizontal roller shaft 58*a* extending in a direction perpendicular to the sheet take-in direction X, both ends of which are near to the left and right side plates 16L and 16R, respectively, left and right press rollers 58*b* and 58*c* which are fixed coaxially to the roller shaft 58*a* and arranged to rollingly contact the left and right endless belts 54L and 54R, respectively, and left and right support blocks 58*d* and 58*e* which are rotatably supporting both ends of the roller shaft 58*a*, respectively.

A left guide slit 58*f* which extends vertically is formed to the left side surface of the left support block 58*d* and a left guide ridge 59L which extends vertically is attached to the inner surface of the left side plate 16L, while the left guide ridge 59L is fitted into the left guide slit 58*f* so as to be able to freely slide therein vertically. A right guide slit 58*g* which extends vertically is formed to the right side surface of the right support block 58*e* and a right guide ridge 59R which extends vertically is attached to the inner surface of the right side plate 16R, while the right guide ridge 59R is fitted into the right guide slit 58*g* so as to be able to freely slide therein vertically. Thus, the press roller assembly 58 is supported to the side plates 16L and 16R to be movable vertically.

Each of the left and right support blocks 58*d* and 58*e* has a cavity 58*h* which penetrates vertically therethrough. A toothed pulley 58*i* is rotatably supported in the each cavity 58*h* about an axis parallel to the central axis of the roller shaft 58*a*. A ring-like groove 58*j* which is arranged around the center of the toothed pulley 58*i* and is formed to one side surface of the toothed pulley 58*i*. A coil spring 58*k* is inserted into the ring-like groove 58*j*.

One end portion of the coil spring 58*k* is urgingly abut against the bottom of the ring-like groove 58*j* while the other end portion thereof is urgingly abut against the side wall of the cavity 58*h*, accordingly, the rotation of the toothed pulley 58*i* is elastically inhibited by the frictional engagement of the coil spring 58*k* with the toothed pulley 58*i* and the side wall of the cavity 58*h*. Note that the toothed pulley 58*i* is set to be capable of rotating if a rotational force larger than the frictional engagement force is applied to the toothed pulley 58*i*.

A driven shaft 64 is disposed above the upper pulley shaft 46 in the frame 16 and rotatably supported to the left and right side plates 16L and 16R at both ends thereof about a horizontal axis which extends in a direction perpendicular to the sheet take-in direction X. A pair of toothed driven pulleys 66 are arranged above the toothed pulleys 58*i* in the left and right support blocks 58*d* and 58*e*, respectively, and are fixed coaxially to the driven shaft 64. On the other hand, a pair of toothed driving pulleys 68 are arranged below the toothed driven pulleys 66, respectively, and just above the base 12 and fixed coaxially to a driving shaft 70 which is rotatably supported to the base 12.

Figure 6:
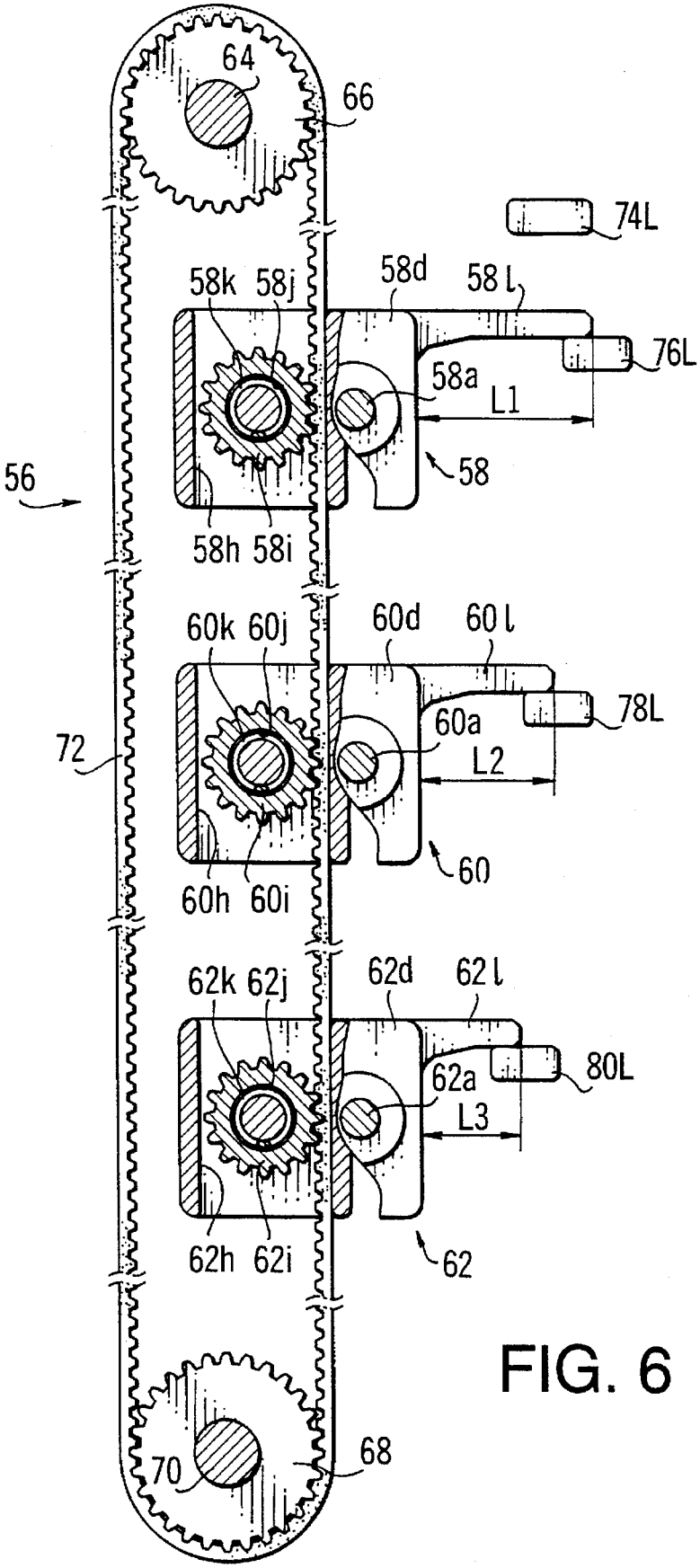
FIG. 6 is an elevational sectional view showing a part of the press roller mechanism taken out in line VI—VI in FIG. 5.
Figure 7:
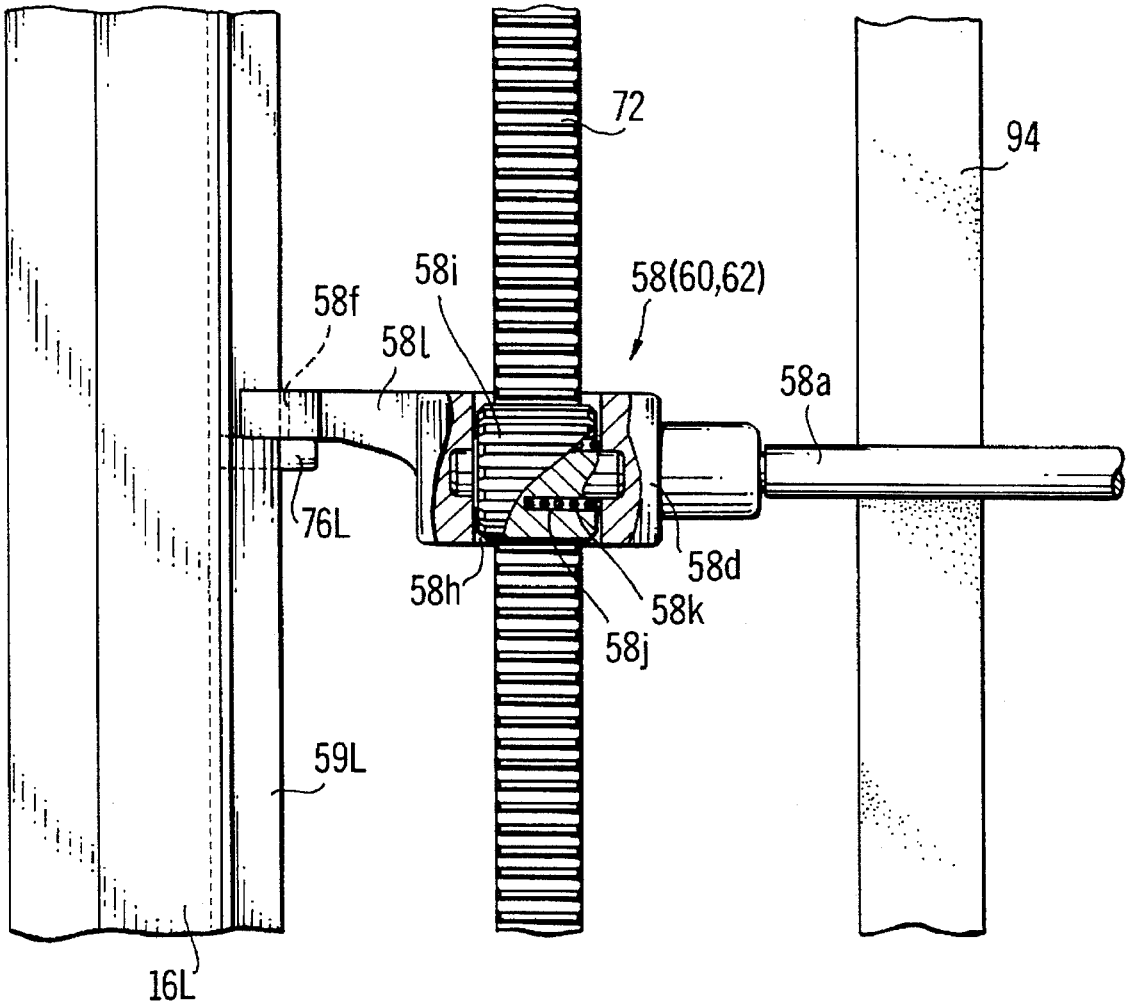
FIG. 7 is a side view showing a part of the first press roller assembly.

As shown in FIGS. 2 and 6, an endless toothed timing belt 72 is wound between the toothed driven pulley 66 on the left side and the toothed driving pulley 68 on the left side, passing through the cavities 58*h*, 60*j* and 62*j* successively and meshing with the toothed pulleys 58*i*, 60*k* and 62*k* in the respective left support blocks 58*d*, 60*d* and 62*d* while an endless toothed timing belt 72 is wound between the toothed driven pulley 66 on the right side and the toothed driving pulley 68 on the right side, passing through the cavities 58*h*, 60*j* and 62*j* successively and meshing with the toothed pulleys 58*i*, 60*k* and 62*k* in the respective right support blocks 58*e*, 60*e* and 62*e*, as shown in FIG. 6. Accordingly, the support blocks 58*d*, 60*d* and 62*d*; 58*e*, 60*e* and 62*e* (that is, the press roller assemblies 58, 60 and 62) are relatively movably connected to the endless toothed timing belt 72, while they are moved vertically upon the rotation of the driving shaft 68.

More specifically, when the driving shaft 68 is rotated clockwise in FIG. 6, the press roller assemblies 58, 60 and 62 are moved down, while when the driving shaft 68 is rotated counterclockwise in FIG. 6, they are moved up. On the other hand, the press roller assemblies 58, 60 and 62 are held in their positions and the endless toothed timing belt 72 only is run even though the driving shaft 68 is rotated, when they are stopped.

As shown in FIG. 6, the first press roller assembly 58 has engagement protrusions 58*l* and 58*m* which are integrally formed to the support blocks 58*d* and 58*e*, respectively, and extend in a direction opposite to the sheet take-in direction X by a first predetermined length L1, the second press roller assembly 60 has engagement protrusions 60*l* and 60*m* which are integrally formed to the support blocks 60*d* and 60*e*, respectively, and extend in a direction opposite to the sheet take-in direction X by a second predetermined length L2, and the third press roller assembly 62 has engagement protrusions 62*l* and 62*m* which are integrally formed to the support blocks 62*d* and 62*e*, respectively, and extend in a direction opposite to the sheet take-in direction X by a third predetermined length L3.

Note that the amounts of the first through third lengths L1, L2 and L3 are defined by an inequality as follows:

$$L1>L2>L3$$

As shown in FIGS. 2 and 6, left and right upper limit stoppers 74L and 74R are attached to the left and right side plates 16L and 16R, respectively, with which the first engagement protrusions 58*l* and 58*m* of the support blocks 58*d* and 58*e* are engaged from the below, thereby defining an upper limit position of the support blocks 58*d* and 58*e*. Left and right first stoppers 76L and 76R are attached to the left and right side plates 16L and 16R, respectively, at an upper position in the frame 16, with which the first engagement protrusions 58*l* and 58*m* of the support blocks 58*d* and 58*e* are engaged from the above, respectively, thereby defining an upper position of the support blocks 58*d* and 58*e*.

Left and right second stoppers 78L and 78R are attached to the left and right side plates 16L and 16R, respectively, at a middle position in the frame 16, with which the second engagement protrusions 60*l* and 60*m* of the support blocks 60*d* and 60*e* are engaged from the above, respectively, thereby defining a middle position of the support blocks 60*d* and 60*e*. Left and right third stoppers 80L and 80R are attached to the left and right side plates 16L and 16R, respectively, at a lower position in the frame 16, with which the third engagement protrusions 62*l* and 62*m* of the support blocks 62*d* and 62*e* are engaged from the above, respectively, thereby defining a lower position of the support blocks 62*d* and 62*e*.

The lower position of the support blocks 62*d* and 62*e* is restricted in such a manner that the sheet which is to be fed to the lowermost fourteenth sorting tray 20N can be frictionally engaged with the endless belts 54L and 54R by being pressed by the press rollers 62*b* and 62*c* of the third press roller assembly 62 in the lower position.

The first stoppers 76L and 76R are limited to locate in such a manner that they are only engageable with the first engagement protrusions 58*l* and 58*m*, respectively, when the first press roller assembly 58 is moved down from the upper limit position. The second stoppers 78L and 78R are limited to locate in such a manner that they are only engageable with the second engagement protrusions 60*l* and 60*m*, respectively, when the second press roller assembly 60 is move down from the upper limit position. The third stoppers 80L and 80R are limited to locate in such a manner that they are only engageable with the third engagement protrusions 62*l* and 62*m*, respectively, when the third press roller assembly 62 is move down from the upper limit position.

Since the press roller mechanism 56 is constructed as described above in detail, when the driving shaft 68 is driven to rotate counterclockwise in FIG. 6, the right portion of the toothed endless timing belt 72 is run upward, the first through third press roller assemblies 58, 60 and 62 are moved up. When the engagement protrusions 58*l* and 58*m* of the uppermost first press roller assembly 58 are abut against the upper limit stoppers 74L and 74R, respectively, from the below, the toothed pulley 58*i* is then allowed to rotate counterclockwise upon the running of the toothed endless timing belt 72 against the frictional engagement due to the urging force of the coil spring 58*k*, thereby allowing to hold the first press roller assembly 58 in its upper limit position.

When the driving shaft 68 is further rotated counterclockwise, the second and third press roller assemblies 60 and 62 are further moved up. When the upper surfaces of the support blocks 60*d* and 60*e* of the second press roller assembly 60 are abut against the undersurfaces of the support blocks 58*d* and 58*e*, respectively, of the first press roller assembly 58 in the upper limit position, from the below, the toothed pulley 60*k* is then allowed to rotate counterclockwise upon the running of the toothed endless timing belt 72 against the frictional engagement due to the urging force of the coil spring 60*m*, thereby allowing to hold the second press roller assembly 60 in its upper limit position.

When the driving shaft 68 is still further rotated counterclockwise, the third press roller assembly 62 is further moved up. Consequently, when the upper surfaces of the support blocks 62*d* and 62*e* of the third press roller assembly 62 are abut against the undersurfaces of the support blocks 60*d* and 60*e*, respectively, of the second press roller assembly 60 in the upper limit position, from the below, the toothed pulley 62*k* is then allowed to rotate counterclockwise upon the running of the toothed endless timing belt 72 against the frictional engagement due to the urging force of the coil spring 62*m*, thereby allowing to hold the third press roller assembly 62 in its upper limit position.

Figure 8:
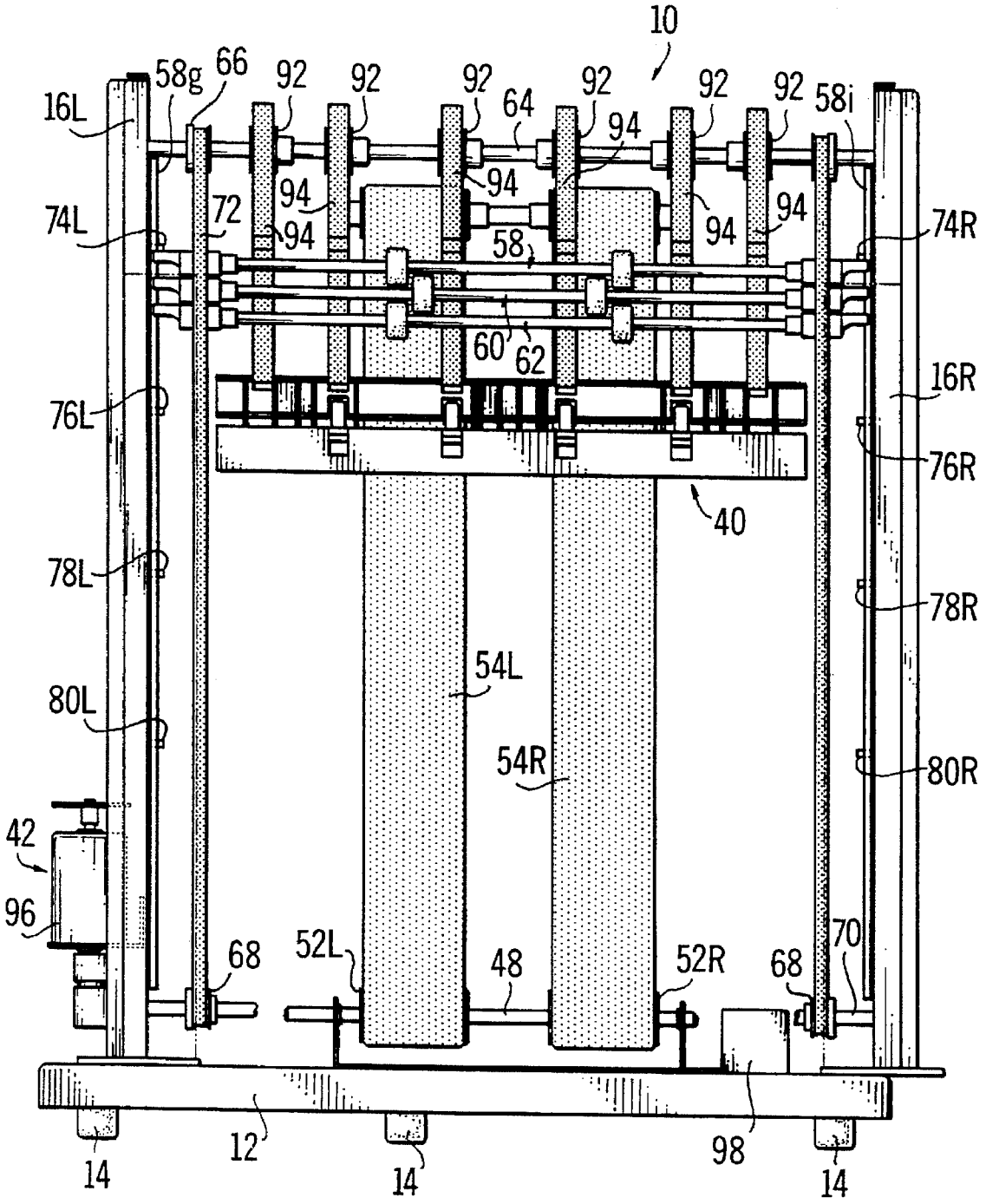
FIG. 8 is a side view showing the sorter of the preferred embodiment where all of the press roller assemblies are moved up their upper limit position and a distributing unit is also moved up its non-sorting position.

Accordingly, all of the press roller assemblies 58, 60 and 62 are located in their upper limit position, as shown in FIG. 8. In this condition, the press rollers 60*b* and 60*c* of the second press roller assembly 60 are offset in the axial direction of the shaft 60*a* from the press rollers 58*b* and 58*c* of the first press roller assembly 58 as well as from the press rollers 62*b* and 62*c* of the third press roller assembly 62, respectively, as clearly understood from FIG. 8. As a result, when all of the press roller assemblies 58, 60 and 62 are raised up to their upper limit position, they are closely gathered.

Note that the distributing unit 40 is simultaneously moved up or down corresponding to the movement of the press roller mechanism 56 because the driving shaft 68 for moving the press roller assemblies 58, 60 and 62 also functions as a drive member for unit drive mechanism 42 for moving the distributing unit 40, which will be described later in detail.

When the distributing unit 40 is moved up to its upper limit position where the sheet which has been fed by the endless belts 54L and 54R is to be distributed to and received on the second sorting tray 20B, the press roller assemblies 58, 60 and 62 are restricted to locate in their upper limit position, as shown in FIG. 8. Accordingly, the sheet will be certainly distributed to and received on the second sorting tray 20B because the sheet will be clamped between the press rollers 58*b* and 58*c*; 60*b* and 60*c*; and 62*b* and 62*c* of the first through third press roller assemblies 58, 60 and 62 in their upper limit position and the endless belts 54L and 54R, whereby the sheet will be pressed to the endless belts 54L and 54R by the press rollers 62*b* and 62*c* thereby frictionally engaging the endless belts 54L and 54R.

On the other hand, when the driving shaft 68 is driven to rotate clockwise in FIG. 6, the right portion of the toothed endless timing belt 72 is run downward, accordingly, the first through third press roller assemblies 58, 60 and 62 are moved down. When the engagement protrusions 58*l* and 58*m* of the uppermost first press roller assembly 58 are engaged with the first stoppers 76L and 76R, respectively, from the above, the toothed pulley 58*i* is then allowed to rotate clockwise upon the running of the toothed endless timing belt 72 against the frictional engagement due to the urging force of the coil spring 58*k*, thereby allowing to hold the first press roller assembly 58 in its upper position.

When the driving shaft 68 is further rotated clockwise, the second and third press roller assemblies 60 and 62 are further moved down. When the engagement protrusions 60*l* and 60*o* of the second press roller assembly 60 are engaged with the second stoppers 78L and 78R, respectively, from the above, the toothed pulley 60*k* is then allowed to rotate clockwise upon the running of the toothed endless timing belt 72 against the frictional engagement due to the urging force of the coil spring 60*m*, thereby allowing to hold the second press roller assembly 60 in its middle position.

When the driving shaft 68 is further rotated clockwise, the third press roller assembly 62 is further moved down. When the engagement protrusions 62*l* and 62*m* of the third press roller assembly 62 are engaged with the third stoppers 80L and 8OR, respectively, from the above, the toothed pulley 62*k* is then allowed to rotate clockwise upon the running of the toothed endless timing belt 72 against the frictional engagement due to the urging force of the coil spring 62*m*, thereby allowing to hold the third press roller assembly 62 in its lower position, as shown in FIG. 2.

Note that, when the distributing unit 40 is moved down to its lower limit position where the sheet which has been fed by the endless belts 54L and 54R is to be distributed to and received on the lowermost fourteenth sorting tray 2ON, the press roller assemblies 58, 60 and 62 are restricted to locate in the upper position, the middle position and the lower position, respectively, as shown in FIG. 2. Accordingly, the sheet will be certainly distributed to and received on the fourteenth sorting tray 20N because the sheet will be clamped between the press rollers 62*b* and 62*c* of the third press roller assembly 62 in the lower position and the endless belts 54L and 54R, whereby the sheet will be pressed to the endless belts 54L and 54R by the press rollers 62*b* and 62*c* thereby frictionally engaging the endless belts 54L and 54R.

Description of distributing unit 40

As shown in FIGS. 2 and 3, the distributing unit 40 is provided for distributing the sheet, which is fed downward from the flapper 38 in the sorting rotational position by the sheet feed mechanism 30, to a predetermined sorting tray 20. The distributing unit 40 is set to be movable vertically and driven to move up or down by the unit drive mechanism 42 which will be described later.

The distributing unit 40 includes a lower body 82A having a pawl 84 which protrudes inside the endless belts 54L and 54R therebetween, for engaging the lower end of the sheet fed downward by the sheet feed mechanism 32, thereby peeling off from the endless belts 54L and 54R, and an upper body 82B disposed on the lower body 82A at both sides thereof. , A gap 86 is formed between the lower and upper bodies 82A and 82B, functioning as a passage through which the sheet passes.

A pair of feed rollers 88A and 88B are provided in the distributing unit 40 so that the upper feed roller 88A is rotatably supported in the upper body 82B and the lower feed roller 88B is rotatably supported in the lower body 82A, while the feed rollers 88*a* and 88B are pressingly contacted with each other by a spring 90. In the present embodiment, the lower feed roller 88B is constructed as a drive roller which is driven to rotate by a drive motor which is not shown but provided in the lower body 82A.

As a result, the sheet which has been peeled off from the endless belts 54L and 54R is passing through the gap 86, clamped between the upper and lower feed rollers 88A and 88B and then discharged to a predetermined sorting tray 20 from an exit of the gap 86 upon the rotation of the lower feed roller 88B.

Description of unit drive mechanism 42

The unit drive mechanism 42 is provided for driving to move the distributing unit 40 up or down and includes the driving shaft 68, the driving pulley 68, the driven shaft 64, the driven pulley 66 and the endless toothed timing belt 72 as described above. The unit drive mechanism 42 further includes plural numbers of, for example six in the present embodiment, reels 92 which are fixed coaxially to the driven shaft 64 at a predetermined interval, ribbons 94 one ends of which are connected to the reels 92, respectively, and the other ends of which are connected to the distributing unit 40, for hanging the distributing unit 40, a drive motor 96 and a drive force transmitting mechanism which is not shown in detail but provided between the drive motor 96 and the driving shaft 70 to transmit the driving force of the drive motor 96 to the driving shaft 70 (accordingly, to the driven shaft 64).

Each of the reels 92 is constructed to wind up the corresponding ribbon 94 by a predetermined winding up force of a spring (not shown). This winding up force is set to be balanced to the weight of the distributing unit 40. Accordingly, the distributing unit 40 is moved up or down upon the rotation of the reels 92 while it is urged upward by the spring provided in the reels 92.

Note that the driving shaft 68, the driving pulley 68, the driven shaft 64, the driven pulley 66 and the endless toothed timing belt 72 of the unit drive mechanism 42 constitute the drive mechanism of the press roller mechanism 56.

Description of control system

Now, description will be given about a control system including a control unit 98 shown in FIG. 2.

In the control operation of the control unit 98, a non-sort mode and a sort mode are alternately defined upon an every depression of a mode switching button which is not shown but attached to the control panel. Note that the sorting treatment and the grouping treatment as described above are selectively executed when the sorting mode is selected.

Description of non-sort mode

Where the non-sort mode is selected, the control unit 98 to control the drive motor 96 so that the distributing unit 40 is moved up to the non-sorting position. When the distributing unit 40 is moved up to the non-sorting position, the flapper 38 is rotated from the sort rotational position to the non-sort rotational position. Accordingly, the sheet, which is taken in by the sheet take-in mechanism 30, is passed over the flapper 38 and fed straightly to the nip between the upper and lower outlet rollers 36A and 36B. Then the rotation of the lower outlet roller 36B, the sheet is discharged onto the non-sorting tray 20A. The followed sheets are also discharged and stacked on the non-sorting tray 20A.

Description of sort mode

Where the sort mode is selected, the control unit 98 controls to drive the drive motor 96 so that the distributing unit 40 is moved down from the non-sorting position to a first sorting position where it faces to the first sorting tray 20B, in other words, the sheet is to be discharged to the first sorting tray 20B through the distributing unit 40 in the first sorting position.

On the other hand, upon the descent of the distributing unit 40 from the non-sorting position to the first sorting position, the flapper 38 is rotated from the non-sort rotational position to the sort rotational position. Accordingly, the sheet which is taken in by the sheet take-in mechanism 30 is rendered to fall down to the sheet feed mechanism 32. Then, the control unit 98 discriminates whether or not the sorting treatment is selected.

Description of grouping treatment

Where the grouping treatment is selected upon a depression of a changeover button which is not shown but is attached to the control panel, all of the sheets with the first page are stacked on the first sorting trays 20B through the distributing unit 40 in the first sorting position. When it is detected that the last copied sheet with the first page is received on the first sorting tray 20B, the control unit 98 starts to drive the drive motor 96 to move the distributing unit 40 down to a second sorting position where it faces to the second sorting tray 20C, in other words, the sheet is to be discharged to the second sorting tray 20C through the distributing unit 40 in the second sorting position.

Then, all copied sheets with the second page are transferred from the copying machine and received on the second sorting tray 20C through the distribute port 24 in the second sorting position. When it is detected that the last copied sheet with the second page is received on the second sorting tray 20C, the control unit 98 executes the same operation for the sheet with the next page, sequentially. Finally, when it is detected that the last sheet with the last page is received on the corresponding sorting tray, the control unit 98 stops the execution of the control operation.

As clearly understood from the above description, where a case ten pages of the sheets are distributed to the first through ten sorting trays 20B through 20K in the grouping treatment, is supposed, all sheets with the tenth page are distributed to the tenth sorting tray 20K through the distributing unit 40 in the tenth sorting position. In this case, the sheet is firstly clamped between the press rollers **58*b* and 58*c* of the first press roller assembly 58 which is located in the upper stop position, secondly clamped between the press rollers 60*b* and 60*c* of the second press roller assembly 60 which is located in the middle stop position, and then clamped between the press rollers 62*b* and 62*c* of the third press roller assembly 62 which is located in the lower stop position. Accordingly, the sheet is always frictionally engaged with the endless belts 54L and 54R all over the feed path of the sheet feed mechanism 32, therefore, the sheet is certainly fed upon the running of the endless belts 54L and 54R**.

Description of sorting treatment

In the present embodiment, a case where three(3) sets of copied sheets P, each set including two(2) pages, is supposed in the sorting treatment, as a matter of convenience.

Where the sorting treatment is selected upon the depression of the changeover button, a first sheet with a first page is transferred from the copying machine and distributed to the first sorting tray 20B through the distributing unit 40 in the first sorting position. When it is detected that the first sheet with the first page has been stacked on the first sorting tray 20B, the control unit 98 controls the drive motor 96 to rotate so that the distributing unit 40 is moved down to a second sorting position where it faces to the second sorting tray 20C.

Then, a second sheet with the first page is transferred from the copying machine and distributed to the second sorting tray 20C through the distributing unit 40 in the second sorting position. When it is detected that the second sheet with the first page has been stacked on the second sorting tray 20C, the control unit 98 controls the drive motor 96 to rotate so that the distributing unit 40 is moved down to a third sorting position where it faces to the third sorting tray 20D.

Then, a third or last sheet with the first page is transferred from the copying machine and distributed to the third sorting tray 20D through the distributing unit 40 in the third sorting position. When it is detected that the third sheet with the first page has been stacked on the third sorting tray 20D, a first sheet with a second page is transferred from the copying machine and distributed to the third sorting tray 20D through the distributing unit 40 in the third sorting position. Accordingly, the first sheet with the second page is stacked on the third sheet with the first page received on the third sorting tray 20D. Then, the control unit 98 controls the drive motor 96 to rotate so that the distributing unit 40 is moved up to the second sorting position.

Then, a second sheet with the second page is transferred from the copying machine and distributed to the second sorting tray 20C through the distributing unit 40 in the second sorting position. When it is detected that the second sheet with the second page has been stacked on the second sorting tray 20C, the control unit 98 controls the drive motor 96 to rotate so that the distributing unit 40 is moved up to the first sorting position.

Then, a third or last sheet with the second page is transferred from the copying machine and distributed to the first sorting tray 20B through the distributing unit 40 in the first sorting position. When it is detected that the third sheet with the second page has been stacked on the first sorting tray 20B, the control unit 98 stops the execution of the control operation.

As clearly understood from the above description, where a case where ten sets of copied sheets P, each set including plural pages are distributed to the first through ten sorting trays 20B through 20K in the sorting treatment is supposed, the last set of sheets with the tenth page are distributed to the tenth sorting tray 20K through the distributing unit 40 in the tenth sorting position. In this case, the sheet is firstly clamped between the press rollers **58*b* and 58*c* of the first press roller assembly 58 which is located in the upper stop position, secondly clamped between the press rollers 60*b* and 60*c* of the second press roller assembly 60 which is located in the middle stop position, and then clamped between the press rollers 62*b* and 62*c* of the third press roller assembly 62 which is located in the lower stop position. Accordingly, the sheet is always frictionally engaged with the endless belts 54L and 54R all over the feed path of the sheet feed mechanism 32, therefore, the sheet is certainly fed upon the running of the endless belts 54L and 54R**.

Description of modification

In the aforementioned embodiment, the sorter 10 is connected to the electrostatic copying machine. However, the present invention is not limited such a connection but the sorter according to the present invention is capable of connecting to a printer or image forming apparatus such as a sheet processor.

In the above-mentioned embodiment, the first through third press roller assemblies 58, 60 and 62 of the press roller mechanism 56 are moved up or down according to the running of the endless toothed timing belts 72. However, the present invention is not limited such a construction but it is possible to move the press roller mechanism 56 according to the movement of the distributing unit 40 whereby the distributing unit 40 is capable of contacting and lifting the third press roller assembly 62. Further, it is possible to move the press roller mechanism 56 not by the timing belts 72 which is also used in the unit drive mechanism 42 but by another timing belt which is not used to the unit drive mechanism 42.

In the above-mentioned embodiment, the press roller mechanism 56 includes three sets of press roller assemblies 58, 60 and 62. However, the present invention is not limited to such a construction but it is possible to include at least one press roller assembly where the size of the sorter is small.

In the above-mentioned embodiment, the clutch mechanism for coupling or discoupling the timing belt 42 to or from each of the support blocks **58*d*, 60*d* and 62*d* of the first through third press roller assemblies 58, 60 and 62, respectively is constructed by the coil springs 58*k*, 60*k* and 62*k***. However, the present invention is not limited to such a construction of the clutch mechanism but it is possible to construct the clutch mechanism from a hydraulic clutch or a electrostatic magnetic solenoid and so on.

As the present invention may be embodied in several forms without departing from the spirit of essential characteristics thereof, the present embodiment is therefore illustrative and not restrictive, since the scope of the present invention is defined by the appended claims rather than by the description preceding them, and all changes that fall within meets and bounds of the claims, or equivalence of such meets and bounds are therefore intended to embraced by the claims.

What is claimed is:

1. A sorter which comprises:

a feed belt for feeding a sheet, which is transferred from a sheet processor, in one direction;

belt drive means for running the feed belt in said one direction;

a plurality of sorting trays, onto which at least one sheet is received, and which are stationary and arranged along said feed belt;

distributing means for distributing the sheet fed upon the running of said feed belt to a predetermined sorting tray, said distributing means being movable along said feed belt to face to said predetermined sorting tray;

press means for pressing the sheet to the feed belt so that the sheet is frictionally engaged with said feed belt, thereby feeding the sheet upon the running of the feed belt, said press means being movable along said feed belt; and moving means for moving said press means along said feed belt in said one direction or a direction opposite to said one direction selectively wherein said moving means includes an additional belt which is run along said feed belt and engaging means for engaging said press means with said additional belt, thereby moving the press means upon the running of said feed belt.

2. The sorter according to claim 1, wherein said moving means moves said press means in accordance with the movement of said distributing means.

3. The sorter according to claim 1, wherein said feed belt is formed of an endless belt.

4. A sorter which comprises:

a feed belt for feeding a sheet, which is transferred from a sheet processor, in one direction;

belt drive means for running the feed belt in said one direction;

a plurality of sorting trays, onto which at least one sheet is received, and which are stationary and arranged along said feed belt;

distributing means for distributing the sheet fed upon the running of said feed belt to a predetermined sorting tray, said distributing means being movable along said feed belt to face to said predetermined sorting tray;

press means for pressing the sheet to the feed belt so that the sheet is frictionally engaged with said feed belt, thereby feeding the sheet upon the runninq of the feed belt, said press means being movable along said feed belt; and moving means for moving said press means along said feed belt in said one direction or a direction opposite to said one direction selectively wherein said press means includes:

a shaft;

at least one press roller which is fixed coaxially to said shaft and which is rollingly contacted to said feed belt; and a support block for rotatably supporting each end of said shaft.

5. The sorter according to claim 4, wherein said moving means includes an additional belt which is run along said feed belt and engaging means for engaging the support block of said press means with said additional belt, thereby moving the press means upon the running of said feed belt.

6. The sorter according to claim 5, wherein said feed belt is formed of an endless belt.

7. The sorter according to claim 6, which further comprises:

clutch means provided between said endless belt and said support block, for connecting or disconnecting the support block and the endless belt, said support block being moved upon the running of said endless belt where said clutch means is connected, while said support block being stopped where said clutch means is disconnected.

8. The sorter according to claim 7, wherein said clutch means is constructed to allow a frictional engagement of the support block with said endless belt under a predetermined engaging force, said support block being moved upon the running of said endless belt where the movement of said support block is not prevented, while said support block being stopped where the movement of said support block is prevented.

9. The sorter according to claim 8, which further comprises:

at least one stop member arranged beside said endless belt having a predetermined height, for engaging said support block to stop the press means in said predetermined height.

10. A sorter which comprises:

a feed belt for feeding a sheet, which is transferred from a sheet processor, in one direction;

belt drive means for running the feed belt in said one direction;

a plurality of sorting trays, onto which at least one sheet is received, and which are stationary and arranged along said feed belt;

distributing means for distributing the sheet fed upon the running of said feed belt to a predetermined sorting tray, said distributing means being movable along said feed belt to face to said predetermined sorting tray;

drive means for driving said distributing means to move along said feed belt in said one direction or in a direction opposite to said one direction selectively;

press means for pressing the sheet to the feed belt so that the sheet is frictionally engaged with said feed belt, thereby feeding the sheet upon the running of the feed belt, said press means being movable along said feed belt; and moving means for moving said press means along said feed belt in said one direction or in a direction opposite to said one direction selectively.

11. The sorter according to claim 10, wherein said moving means moves said press means in accordance with the movement of said distributing means.

12. The sorter according to claim 10, wherein said moving means includes an additional belt which is run along said feed belt and engaging means for engaging said press means with said additional belt, thereby moving the press means upon the running of said feed belt.

13. The sorter according to claim 10, wherein said feed belt is formed of an endless belt, and said belt is formed of another endless belt.

14. The sorter according to claim 13, wherein said belt drive means includes a drive shaft around which said endless feed belt is wound, and said another endless belt is also wound around said drive shaft.

15. The sorter according to claim 10, wherein said press means includes:

a shaft;

at least one press roller which is fixed coaxially to said shaft and which are rollingly contacted to said feed belt; and support block for rotatably supporting each end of said shaft.

16. The sorter according to claim 15, wherein said moving means includes a belt which is run along said feed belt and engaging means for engaging the support block of said press means with said belt, thereby moving the press means upon the running of said belt.

17. The sorter according to claim 16, wherein said feed belt is formed of an endless belt, and said belt is formed of another endless belt.

18. The sorter according to claim 17 wherein said belt drive means includes a drive shaft around which said endless feed belt is wound, and said another endless belt is also wound around said drive shaft.

19. The sorter according to claim 17, which further comprises:

clutch means provided between said endless belt and said support block, for connecting or disconnecting between the support block and the endless belt, said support block being moved upon the running of said endless belt where said clutch means is connected, while said support block being stopped where said clutch means is disconnected.

20. The sorter according to claim 18, wherein said clutch means is constructed to allow a frictional engagement of the support block with said endless belt under a predetermined engaging force, said support block being moved upon the running of said endless belt where the movement of said support block is not prevented, while said support block being stopped where the movement of said support block is prevented.

21. The sorter according to claim 20, which further comprises:

at least one stop member arranged beside said endless belt having a predetermined height, for engaging said support block to stop the press means in said predetermined height.

22. A sorter, comprising:

a feed belt for feeding a sheet, which is transferred from a sheet processor, in one direction;

belt drive means for running the feed belt in said one direction;

a plurality for sorting trays, onto which at least one sheet is received, and which are stationary and arranged along said feed belt;

distributing means for distributing the sheet fed upon the running of said feed belt to a predetermined sorting tray, said distributing means being movable along said feed belt to face to said predetermined sorting tray;

press means for pressing the sheet to the feed belt so that the sheet is frictionally engaged with said feed belt, thereby feeding the sheet upon the running of the feed belt, said press means being movable along said feed belt;

moving means for moving said press means along said feed belt in said one direction or a direction opposite to said one direction selectively; and means for maintaining a distance between the feed belt and the press means within a predetermined value.

23. The sorter according to claim 22, wherein said maintaining means includes at least one guide for guiding the press means to move along said feed belt.

24. The sorter according to claim 23, wherein said press means includes a shaft, at least one press roller which is fixed coaxially to said shaft and which is rollingly contacted to said feed belt, and a support block for rotatably supporting each end of said shaft, and said guide includes a guide ridge which is inserted into a guide slit formed to said support block to guide the press roller to move along said feed belt.

25. A sorter, comprising:

a feed belt for feeding a sheet, which is transferred from a sheet processor, in one direction;

belt drive means for running the feed belt in said one direction;

a plurality for sorting trays, onto which at least one sheet is received, and which are stationary and arranged along said feed belt;

distributing means for distributing the sheet fed upon the running of said feed belt to a predetermined sorting tray, said distributing means being movable along said feed belt to face to said predetermined sorting tray;

press means for pressing the sheet to the feed belt so that the sheet is frictionally engaged with said feed belt, thereby feeding the sheet upon the running of the feed belt, said press means being movable along said feed belt;

moving means for moving said press means along said feed belt in said one direction or a direction opposite to said one direction selectively; and means for supporting said press means to move along the feed belt.

26. The sorter according to claim 25, wherein said support means includes at least one guide for guiding the press means to move along said feed belt.

27. The sorter according to claim 26, wherein said press means includes a shaft, at lest one press roller which is fixed coaxially to said shaft and which is rollingly contacted to said feed belt, and a support block for rotatably supporting each end of said shaft, and said guide includes a guide ridge which is inserted into a guide slit formed to said support block to guide the press roller to move along said feed belt.

* * * * *